US006834411B2

(12) United States Patent
Kaminstein et al.

(10) Patent No.: US 6,834,411 B2
(45) Date of Patent: Dec. 28, 2004

(54) SHOWER SQUEEGEE

(75) Inventors: Bruce Kaminstein, Blauvelt, NY (US); Flavio Cavalherio, Blauvelt, NY (US)

(73) Assignee: Kaminstein Imports, Inc., Blauvelt, NY (US)

( * ) Notice: Subject to any disclaimer, the term of this patent is extended or adjusted under 35 U.S.C. 154(b) by 0 days.

(21) Appl. No.: 10/328,271

(22) Filed: Dec. 23, 2002

(65) Prior Publication Data

US 2004/0117936 A1 Jun. 24, 2004

(51) Int. Cl.[7] ..... A47L 1/06; A47L 13/11
(52) U.S. Cl. ..... 15/245; 15/245.1
(58) Field of Search ..... 15/121, 245, 245.1; D32/41

(56) References Cited

U.S. PATENT DOCUMENTS

| | | | | | |
|---|---|---|---|---|---|
| 509,875 | A | | 12/1893 | Campbell | |
| 824,473 | A | | 6/1906 | Foskett | |
| 1,497,933 | A | | 6/1924 | Oberti | |
| 1,898,690 | A | * | 2/1933 | Schacht | 15/245 |
| 2,265,551 | A | | 12/1941 | Steccone | |
| D152,375 | S | | 1/1949 | Seley | |
| 2,900,656 | A | * | 8/1959 | Tupper | 15/245 |
| 2,901,762 | A | * | 9/1959 | Bell | 15/245 |
| 3,013,291 | A | * | 12/1961 | Matrick et al. | 15/245 |
| 3,065,485 | A | * | 11/1962 | Peter | 15/245 |
| 3,413,675 | A | | 12/1968 | Westrum | |
| 4,236,270 | A | | 12/1980 | Mavis | |
| 4,654,919 | A | * | 4/1987 | Liberman | 15/245.1 |
| 4,922,569 | A | | 5/1990 | Brinker et al. | |
| 4,970,749 | A | * | 11/1990 | Priore | 15/236.02 |
| 5,101,530 | A | | 4/1992 | Hansen et al. | |
| D332,160 | S | * | 12/1992 | Kuzma | D32/41 |
| D343,265 | S | | 1/1994 | Pollak et al. | |
| 5,351,357 | A | * | 10/1994 | Liberman | 15/245.1 |
| D360,505 | S | * | 7/1995 | Goodman et al. | D32/41 |
| D391,712 | S | | 3/1998 | Immerman | |
| D391,713 | S | | 3/1998 | Laib | |
| 5,809,605 | A | | 9/1998 | Gringer | |
| 5,809,608 | A | | 9/1998 | Zadro | |
| 6,546,589 | B1 | * | 4/2003 | Job | 15/245 |

* cited by examiner

*Primary Examiner*—Randall Chin
(74) *Attorney, Agent, or Firm*—Stephen E. Feldman, P.C.

(57) ABSTRACT

A squeegee assembly is described including a handle connected to a blade. The handle defines a hole for hanging the squeegee from a hook and undulations suitable for enhancing the grip. The blade defines a hole and an edge. The blade hole is configured and dimensioned for having a showerhead positioned therethrough and hanging from the showerhead. The blade hole can also apply a bias to the edge during cleaning. The edge is configured for cleaning and removing water from surfaces.

9 Claims, 5 Drawing Sheets

SHOWER SQUEEGEE

BACKGROUND

1. Technical Field

The present disclosure relates to shower squeegees. More particularly, the present disclosure relates to shower squeegees configured for cleaning surfaces.

2. Background of Related Art

Squeegees commonly have a bracket, a rubber cleaning blade, and a handle. The bracket is configured for retaining the flexible cleaning blade during cleaning operations. The handle frequently defines a hole for hanging the squeegee when it is not in use. The diameter of the hole defined in the handle, however, is limited by the width or diameter of the handle. While these relatively small diameter holes are generally suitable for hanging devices such as squeegees from many residential or commercial hooks, often the process of placing the handle holes onto the hooks requires a fine degree of coordination that is not readily available for many individuals. At other times, the curvature or diameter of the hook binds or precludes the movement of the squeegee being positioned onto or removed from the hook. Thus, an additional level of care of fitting the hook onto and through the hole is required. This demand for additional care to hang or retrieve the squeegee is especially frustrating for people with poor eye sight or those limited by disabilities.

A design for a squeegee is described in U.S. Design Pat. No. 391,713 to Laib. Laib teaches an arcuate shaped handle defining a hole for hanging the squeegee from a small diameter hook. In one embodiment, the squeegee handle has a semicircular shape and a bracket positioned on a diametrical line configured for receiving a rubber blade. While the rubber blade is positioned on the straight linear bracket, the handle can have a flat plate type shape or arcuate undulations running generally perpendicular to the plane defined by the flat plate. Laib, however, is limited by the rigidity of its blade support structure which inhibits the flexible employment of the blade over undulating surfaces. In addition, having only the small hole defined in the handle limits the ability of the squeegee to be hung or stored in different orientations, such as with the handle up or the handle down position. Further, the lack of a larger diameter hole precludes the suspending of the squeegee from larger diameter support structures such as a pipe connected with a shower head. Finally the small holes defined in the handles often bind with the hook as the user attempts to remove them frustrating the ability of the user to easily employ their squeegee.

In U.S. Design Pat. No. 360,505 to Goodman et al. a squeegee is shown having a handle and a blade support structure defining a straight linear slot for receiving a blade. The handle has a first width at a distal end where the handle connects with the blade support structure and a second width at a proximal end of the handle. The handle has an increasing taper from the distal end to the proximal end such that the second width is greater than the first width. The proximal end also defines a through hole in the increased width. The Goodman et al. squeegee is also limited in the orientations from which it can be stored by a hook and the lack of a larger diameter through hole to accommodate fitting the squeegee over larger diameter hanging devices.

In U.S. Pat. No. 509,875 to Campbell, a scraper and shovel is shown having a handle connected to a semicircular blade holding bracket. The diametrical straight line of the semicircular blade holding bracket is configured to receiving and retaining a metal blade. The application of Campbell is limited by the rigidity of its blade, blade support structure, and the flexibility with which the scraper can be stored.

A continuing need exists for a squeegee configured for use in a shower that can be easily hung by a hole defined in the blade when not in use from a shower head.

SUMMARY

A squeegee is described including a handle connected to a blade. The blade defines an edge suitable for cleaning and a hole. The hole has a configuration and dimension adapted for fitting over a shower head. In addition, the blade can be fabricated such that the hole defined in the blade imparts a bias on the edge during cleaning.

The invention, together with attendant advantages, will be best understood by reference to the following detailed description of the invention when used in conjunction with the figures below.

BRIEF DESCRIPTION OF THE DRAWINGS

Preferred embodiments of the presently disclosed shower squeegee are described herein with reference to the drawings, wherein.

DETAILED DESCRIPTION OF THE EMBODIMENTS

Figure 1:
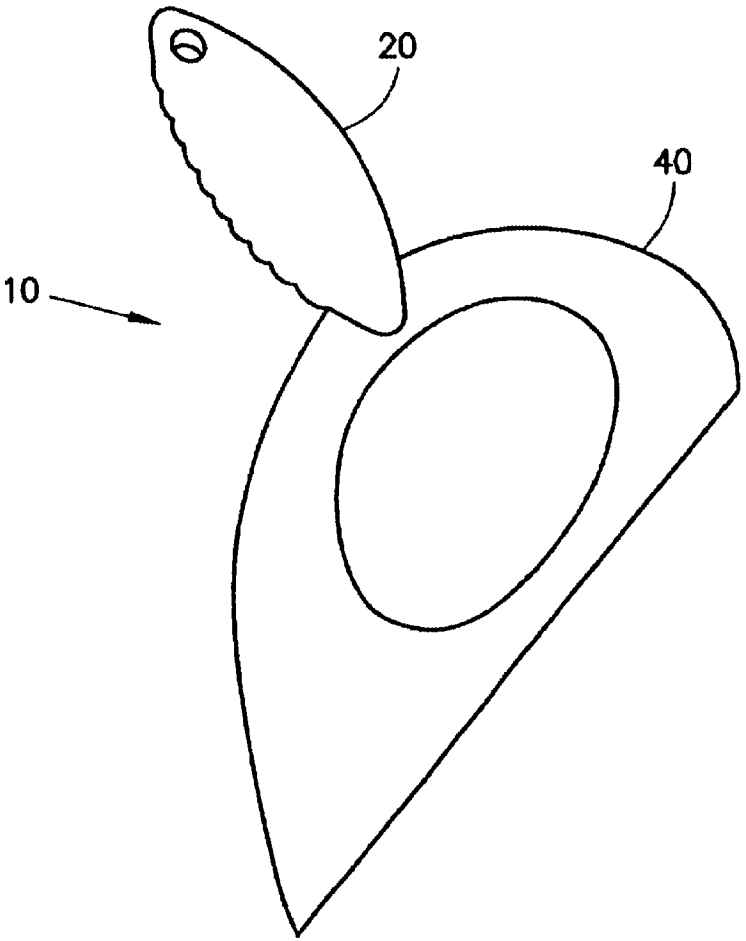
FIG. 1 is a frontal perspective view of a shower squeegee having a flat plate shaped blade constructed in accordance with the present disclosure suspended from a showerhead.
Figure 2A:
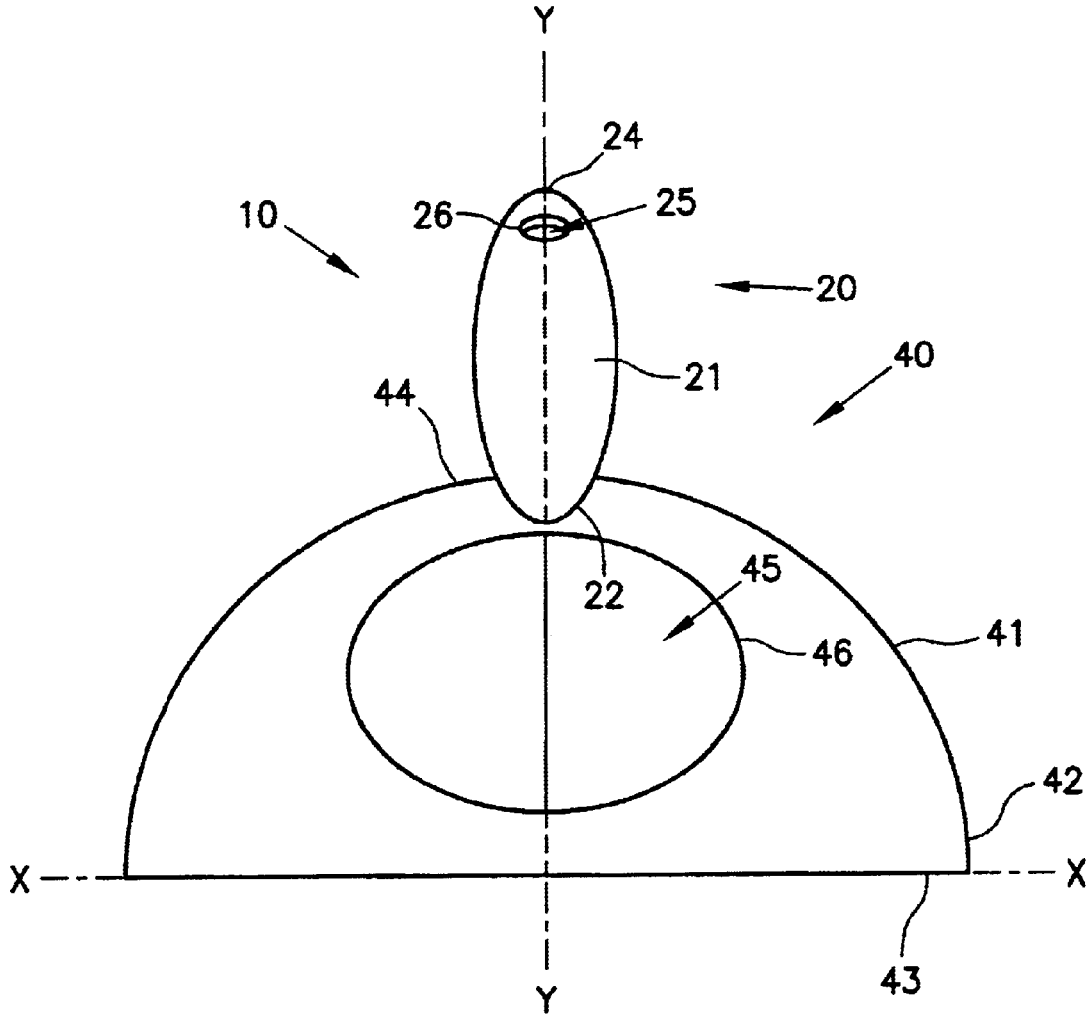
FIG. 2A is a frontal view of the squeegee of FIG. 1 constructed in accordance with the present disclosure.
Figure 2B:
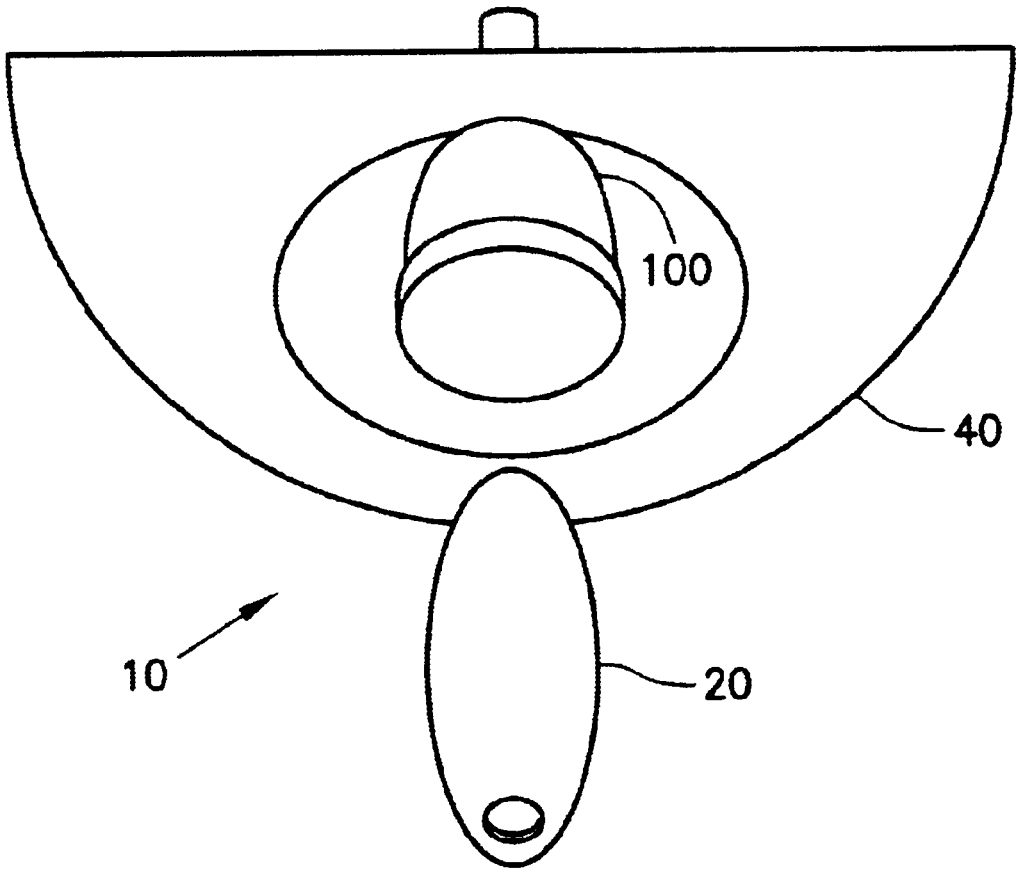
FIG. 2B is a frontal view of the squeegee of FIG. 1 constructed in accordance with the present disclosure.
Figure 3:
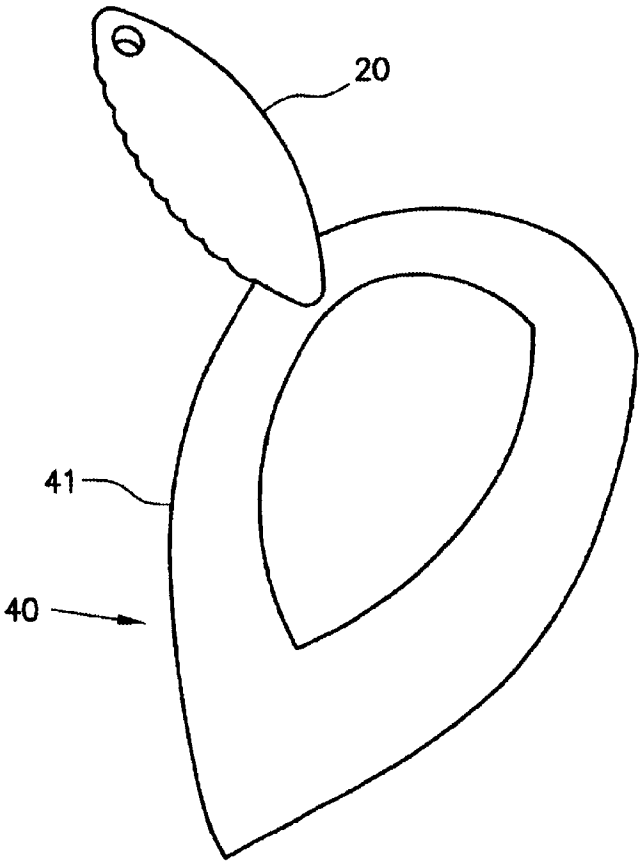
FIG. 3 is a frontal perspective view of the squeegee of FIG. 1 having an arcuate shaped blade constructed in accordance with the present disclosure.
Figure 4:
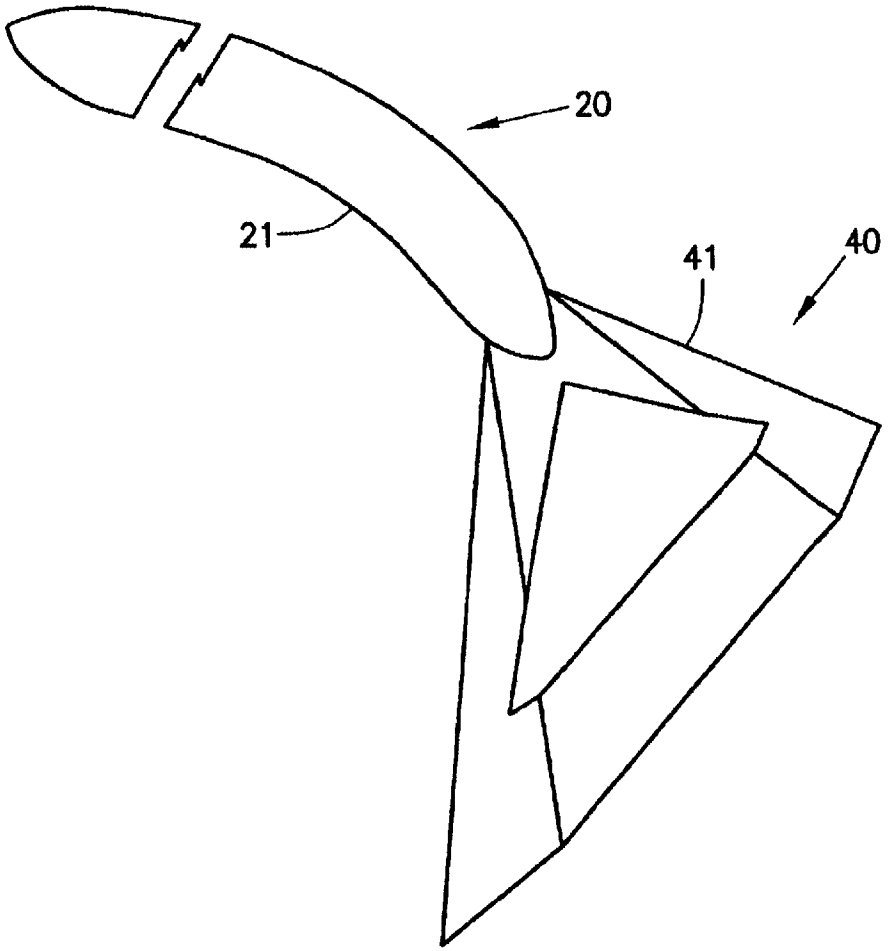
FIG. 4 is a frontal perspective view of the squeegee of FIG. 1 having an angled shaped blade constructed in accordance with the present disclosure.

Referring now in specific detail to the drawings in which like referenced numerals identify similar or identical elements throughout the several views and initially to FIG. 1, a novel shower squeegee assembly, or squeegee 10, is shown including a handle 20 connected to a blade 40.

As shown in FIGS. 2A, 2B, 3, and 4, in one preferred embodiment, squeegee assembly 10 includes handle 20 fixedly connected with blade 40 defining an axis-Y. Edge 43 defines an axis-X perpendicular to intersecting with axis-Y. Squeegee assembly 10 is shown hanging from a showerhead 100 with handle 20 hanging down towards the ground.

Handle 20 has a body 21 having an overall generally elongate cylindrical ergonomic shape having a cylindrical center portion and a tapered distal end portion 22 and a tapered proximal end portion 24. Distal end portion 22 and proximal end portion 24 are symmetrically tapered to rounded tips. Distal end portion 22 is connected to blade 40.

A through hole 25 is defined by a rim 26 positioned in proximal end portion 24 adapted for receiving a standard commercial or household hook for the suspending of squeegee 10. Handle 40 preferably includes undulations or ribbings positioned on at least a portion of the handle suitable for enhancing a user's grip on squeegee 10 under wet and dry conditions. While handle 20 in this one preferred embodiment, has a linear elongate cylindrical shape, it is also envisioned handle 20 can be arcuate and have additional ergonomic gripping means such as a pliable gripping portion having concave indentations suitable for the positioning of the fingers and a palm of a user.

Blade 40 has a body 41, a distal end portion 42, and a proximal end 44. Distal end 42 defines a straight linear edge 43 suitable for cleaning and/or scraping windows, shower stalls, or nbathroom utility type surfaces, for example. In one preferred embodiment body 41 has a semicircular flat plate shape having a uniform thickness and a straight linear edge 43. Edge 43 defines a longitudinal axis-X and has a first length "L." Distal end 22 of handle 20 is connected at a mid point of the hole 45 on proximal end portion 44. Body 41, in another preferred embodiment, can also have shapes such as an arcuate or angled shape and include reinforced portions having a greater thickness than the plate thickness. Edge 43 can also be arcuate or include one or more angles corresponding, for example, to the angled or arcuate shape of body 41.

Blade 40 includes a rim 46 defining a through hole 45. In one preferred embodiment handle 20 and blade 40 are positioned in and define a plane X-Y with hole 45 being perpendicular to plane X-Y. Hole 45 can be any shape, but in this one preferred embodiment has an elliptical shape with a major axis parallel to edge 43 and a minor axis aligned with axis-Y. Hole 45 in this one preferred embodiment is approximately one half of length "L" of edge 43, but hole 45 can have any size relationship relative to edge 43 as long as hole 45 is suitable for having a shower head 100 positioned therethrough.

Hole 45 is suitably configured and dimensioned for the positioning of a showerhead 100 therethrough. This enables squeegee assembly 10 to be suspended from hole 45 by showerhead 100 with handle 20 hanging down by the nature of its greater weight than blade 40 and the relative position of hole 45 to handle 20. The downward pointing handle 20 makes squeegee assembly 20 is configured for being easily reached and retrieved from showerhead 100 by a user. In particular, this configuration accommodates accessibility to squeegee 10 by shorter and handicapped users that do not have an extended reach or are unable to easily utilize the traditional handle to hook combination. Hole 45 also advantageously assists persons with poor vision that do not have to painstakingly thread a small hook into a small hole on a squeegee handle. In addition, handle 20 can be configured with an extended length providing even greater ease of retrieval/storage and additional capability to users to access higher and harder to reach places for cleaning.

Handle 20 and blade 40 in one preferred embodiment are fabricated simultaneously or sequentially as an injection molded assembly using one or more plastic materials. Alternatively, handle 20 and blade 40 can be made of the same or different materials and bonded together to form shower squeegee 10. Distal end portion 22 of handle 20 could have a bifurcated distal tip, for example, suitable for receiving proximal end portion 44 of blade 40. Besides plastics, materials for squeegee 10 can include rubber and composite materials suitable for cleaning applications. In at least one preferred embodiment, blade 40 is formed of a material have suitable material qualities for imparting a bias upon compression.

In operation, as shown in FIGS. 1, 2A, 3, and 4, squeegee assembly 10 in this one preferred embodiment is initially hanging from showerhead 100 by hole 45. The user grasps the downward pointing handle and withdraws squeegee 10 from showerhead 100. The user then places edges 43 on the surface of a shower enclosure. The surface of the shower enclosure includes materials typically used in the industry for shower enclosures including tile, fiberglass, plastic materials, or glass. Using a downward motion in combination with a force generally perpendicular to the enclosure wall, the user draws squeegee 10 down the enclosure surface to clean away the moisture and dirt.

In one preferred embodiment, the force applied by a user effectively places a component of that force generally in line with the plane defined by blade 40. This force component compresses blade 40 and blade 40 places an additional bias force as a result of the material qualities of blade 40 in combination with hole 45 on the portions of edge 43 in direct contact with the surface. This makes for an improved cleaning force component against the enclosure by ensure greater force is applied to scrape and/or scrub the dirt, soap scum, and moisture off the enclosure and also ensures a greater edge 43 to enclosure point for point direct contact.

The different shapes of squeegee 10 can be advantageously employed for cleaning. For example, the straight linear edge 43 is preferred for reaching into grout recesses between tiles. An angled or arcuate shaped edge 43 can advantageously collect the scraped dirt, soap scum, and moisture in a central portion of squeegee 10 for subsequent ease of removal.

When the user has finished cleaning, squeegee 10 is washed to remove all the debris from cleaning. Hole 45 of squeegee 10 is then position around showerhead 100 and positioned for storage from showerhead 100 with the handle naturally pointing downwards.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. A shower squeegee assembly comprising:

a substantially cylindrical, elongated handle, the handle positioned along a first axis having a free end and a base end, a blade having a base attached to the base end and a straight edge, the straight edge having a length and being perpendicular to the first axis; wherein:

the free end is opposite the base end;

the base is opposite the straight edge;

the blade has open interior that defines a substantially oblong inner wall, the open interior having a length approximately one half the length of the straight edge and sized to fit over a standard shower head;

the center of the open interior, the center of the handle and the center of the blade are aligned along the first axis; and, the open interior is constructed and arranged to bias the edge when pressure is applied to the straight edge.

2. The squeegee assembly of claim 1, wherein the blade is made of a first material and the handle is made of a second material.

3. The squeegee assembly of claim 1, wherein the blade and handle are made of a single material.

4. The squeegee assembly of claim 1, wherein the squeegee is fabricated of at least one suitable grade plastic, rubber, or composite material.

5. The squeegee assembly of claim 1, wherein the squeegee is injection molded as a single assembly.

6. The squeegee assembly of claim 1, wherein the blade has a generally flat plate shape.

7. The squeegee assembly of claim 1, wherein the blade has an arcuate shape.

8. The squeegee assembly of claim 1, wherein the blade has at an at least partially angled shape.

9. The squeegee assembly of claim 1, wherein the base has a triangular shape.

* * * * *